US005107683A

United States Patent [19]

Chan et al.

[11] Patent Number: 5,107,683

[45] Date of Patent: Apr. 28, 1992

[54] MULTISTAGE PULSE TUBE COOLER

[75] Inventors: Chung K. Chan, Los Angeles; Emanuel Tward, Northridge, both of Calif.

[73] Assignee: TRW Inc., Redondo Beach, Calif.

[21] Appl. No.: 506,318

[22] Filed: Apr. 9, 1990

[51] Int. Cl.[5] ..... F25B 9/00; F25B 7/00

[52] U.S. Cl. ..... 62/6; 62/335

[58] Field of Search ..... 62/6, 5, 335, 512, 51.3; 60/525

[56] References Cited

U.S. PATENT DOCUMENTS

| | | | |
|---|---|---|---|
| 3,260,055 | 7/1966 | Webb | 62/6 |
| 3,314,244 | 3/1967 | Green | 62/6 X |
| 3,318,101 | 5/1967 | Van Geuns | 62/6 |
| 3,372,554 | 3/1968 | Prast et al. | 62/6 |
| 3,400,544 | 9/1968 | Prast | 62/6 |
| 3,431,746 | 3/1969 | Webster et al. | 62/6 X |
| 3,656,313 | 4/1972 | Low et al. | 62/6 |
| 3,817,044 | 6/1974 | Daniels | 62/6 |
| 4,522,032 | 6/1985 | Nakamura | 62/6 |
| 4,700,545 | 10/1987 | Ishibashi et al. | 62/6 |

FOREIGN PATENT DOCUMENTS

| | | | |
|---|---|---|---|
| 0785609 | 12/1980 | U.S.S.R. | 62/6 |
| 0798434 | 1/1981 | U.S.S.R. | 62/6 |
| 1084736 | 9/1967 | United Kingdom | 62/6 |

*Primary Examiner*—Albert J. Makay
*Assistant Examiner*—Christopher B. Kilner
*Attorney, Agent, or Firm*—James M. Steinberger; Sol L. Goldstein

[57] ABSTRACT

A multistage pulse tube cooler in which a portion of the heat from each successively lower-temperature pulse tube cooler is rejected to a heat sink other than the preceding higher-temperature pulse tube cooler, thus substantially improving the overall efficiency of the multistage cooler. Multistage pulse tube coolers of the prior art reject all the heat from each successively lower-temperature pulse tube cooler to the preceding higher-temperature pulse tube cooler, thus imposing a large cooling load on the higher-temperature pulse tube coolers which considerably reduces the overall efficiency of the cooler.

11 Claims, 3 Drawing Sheets

MULTISTAGE PULSE TUBE COOLER

BACKGROUND OF THE INVENTION

This invention relates generally to cryogenic coolers or refrigerators and, more particularly, to multistage cryogenic coolers employing pulse tubes.

Cryogenic coolers are typically used aboard spacecraft for cooling infrared detectors when temperatures below about 100 K are required, since simple radiators become very inefficient at these low temperatures. One type of cryogenic cooler that is frequently used is a closed-cycle expansion cooler which provides cooling through an alternating compression and expansion of a gas, with a consequent reduction of gas temperature. Typical cryogenic coolers of this type include Stirling, Vuilleumier, Gifford-McMahon, Joule-Thomson and pulse tube coolers. Pulse tube coolers are particularly attractive for space applications because they have no cold moving parts, which increases reliability and reduces vibration, and because they operate at comparatively low pressures with high efficiencies.

A single stage pulse tube cooler is generally capable of reaching temperatures of about 70–80 K., while still lower temperatures require some type of staging of the pulse tubes. U.S. Pat. No. 3,237,421 to Gifford and several papers, one by Ray Radebaugh entitled "Pulse Tube Refrigeration-A New Type of Cryocooler" and another by Yuan Zhou et al. entitled "Two-Stage Pulse Tube Refrigeration," disclose multistage pulse tube coolers in which all the heat from each successively lower-temperature pulse tube cooler is rejected to the preceding higher-temperature pulse tube cooler. Unfortunately, the large cooling load imposed on the higher-temperature pulse tube coolers considerably reduces the overall efficiency of the multistage cooler. Accordingly, there has been a need for an improved staging configuration for multistage pulse tube coolers. The present invention is directed to this end.

SUMMARY OF THE INVENTION

The present invention resides in a multistage pulse tube cooler in which a portion of the heat from each successively lower-temperature pulse tube cooler is rejected to a heat sink other than the preceding higher-temperature pulse tube cooler, thus substantially improving the overall efficiency of the multistage cooler. The multistage pulse tube cooler of the present invention includes a plurality of pulse tube coolers arranged to provide successively lower temperatures, with each successively lower-temperature pulse tube cooler receiving cooled gas from the preceding higher-temperature pulse tube cooler. The heat sink is preferably the ambient environment.

Each pulse tube cooler includes, in series, an aftercooler, a regenerator, a cold end heat exchanger, a pulse tube, a hot end heat exchanger, an orifice and a surge tank. Each successively lower-temperature pulse tube cooler extends from the cold end heat exchanger of the preceding higher-temperature pulse tube cooler. The multistage pulse tube cooler is filled with a gas, such as helium or hydrogen, and a compressor supplies the multistage pulse tube cooler with a pressure wave.

In a three stage pulse tube cooler in accordance with the present invention, the compressor supplies a continuous pressure wave to the first stage aftercooler and regenerator. After providing cooling in the first stage regenerator, the pressure wave enters both the first stage cold end heat exchanger and the second stage aftercooler, the second stage aftercooler being in thermal contact with the first stage cold end heat exchanger. The pressure wave provides further cooling in the second stage regenerator and then enters both the second stage cold end heat exchanger and the third stage aftercooler, the third stage aftercooler being in thermal contact with the second stage cold end heat exchanger. The pressure wave provides further cooling in the third stage regenerator, with the third stage cold end heat exchanger being in thermal contact with the cooling load. The pressure wave continues through the pulse tubes, where the work supplied by the compressor is rejected as heat to the heat sink by the first, second and third stage hot end heat exchangers.

It will be appreciated from the foregoing that the present invention represents a significant advance in the field of multistage pulse tube coolers. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENTS

Figure 1:
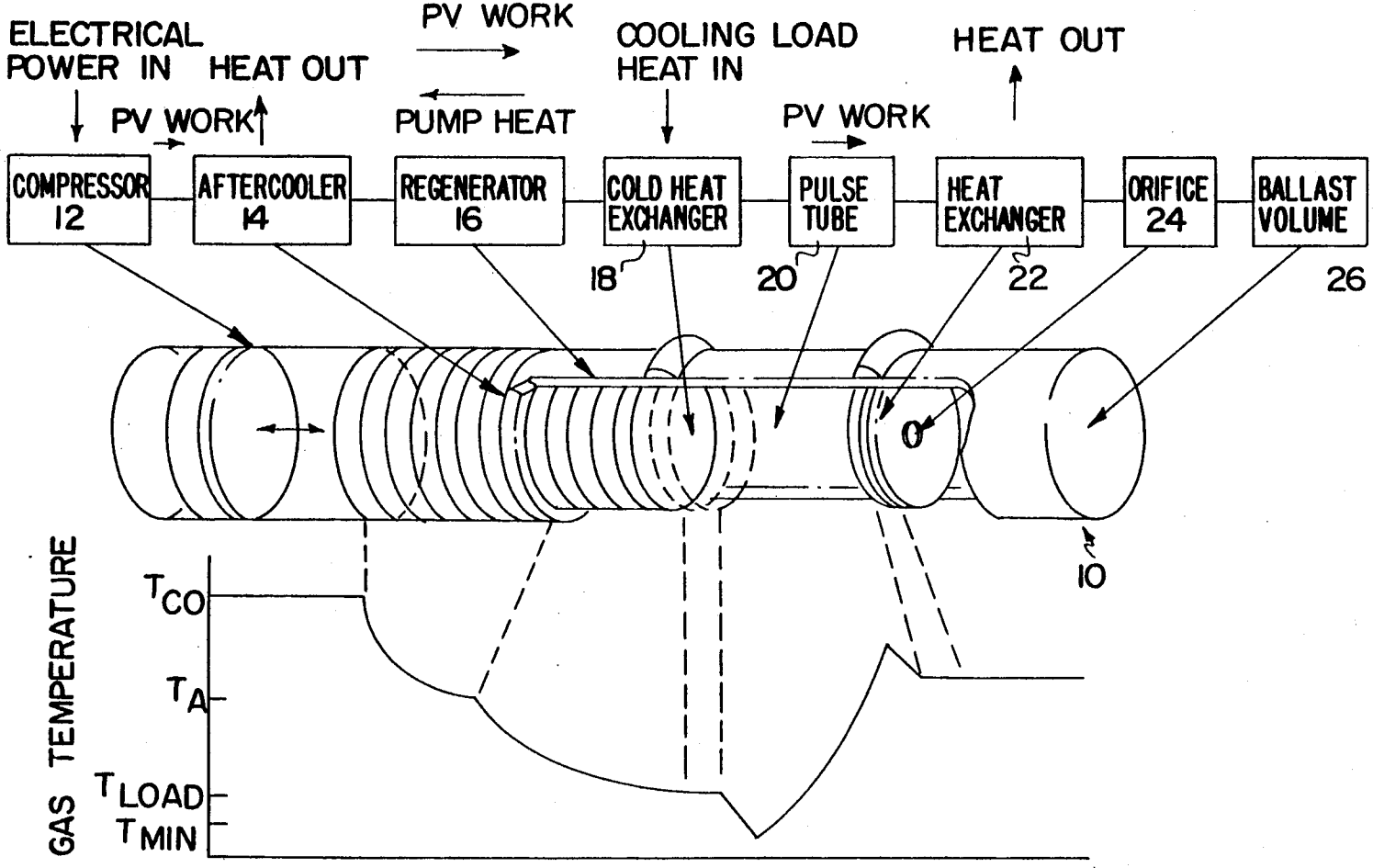
FIG. 1 (PRIOR ART)
FIG. 1 is a perspective view of a single stage pulse tube cooler.

As shown in the drawings for purposes of illustration, the present invention is embodied in a multistage pulse tube cooler in which a portion of the heat from each successively lower-temperature pulse tube cooler is rejected to a heat sink other than the preceding higher-temperature pulse tube cooler, thus substantially improving the overall efficiency of the multistage cooler. Multistage pulse tube coolers of the prior art reject all the heat from each successively lower-temperature pulse tube cooler to the preceding higher-temperature pulse tube cooler, thus imposing a large cooling load on the higher-temperature pulse tube coolers which considerably reduces the overall efficiency of the cooler.

As shown in FIG. 1, a single stage pulse tube cooler 10 is a simple heat pump which pumps heat from a cooling load (not shown) to a heat sink, such as the ambient environment. The pulse tube cooler 10 includes, in series, a pressure wave generator or compressor 12, an aftercooler 14, a regenerator 16, a cold end heat exchanger 18, a pulse tube 20, a hot end heat exchanger 22, an orifice 24 and a surge tank or ballast volume 26. The pulse tube cooler 10 is filled with a gas, such as helium or hydrogen.

In operation, the compressor 12 generates a continuous pressure wave, which causes an alternating mass flow through the pulse tube cooler 10. The compression of the gas also increases the temperature of the gas to a compressor temperature $T_{co}$ which is higher than the ambient temperature $T_A$. However, the gas is cooled back down to the ambient temperature $T_A$ by the aftercooler 14, where the heat is rejected to the heat sink. The alternating pressure and mass flow produced by the compressor 12 is a pressure/volume (PV) work which causes the regenerator 16 to pump heat from the cooling load through the cold end heat exchanger 18 to the aftercooler 14, where the heat is rejected to the heat sink. The result of this heat pumping action is to lower the temperature of the cooling load to $T_{LOAD}$. Meanwhile, the PV work travels down the pulse tube 20, where it is rejected as heat to the heat sink by the hot end heat exchanger 22.

The compressor 12, which is the only component with moving parts, is frequently a piston type compressor. The regenerator 16 is typically a stack of screens which acts as a thermal sponge, alternately absorbing heat from the gas and then rejecting the absorbed heat to the gas as the pressure oscillates back and forth. For efficient operation of the pulse tube cooler 10, the heat transfer between the regenerator 16 and the gas must occur with minimum energy loss. Also, the regenerator must have a large heat capacity compared with that of the gas and, at the same time, have lower thermal conductivity along its length to minimize conduction loss. The efficiency of the regenerator 16 is determined by the screen mesh size and the materials used in fabricating the screens. Packed spheres and parallel plates may be used instead of the stacked screens.

The pulse tube 20 is a thin-walled tube of a lower thermal conductivity material, such as stainless steel. The pulse tube 20 has screen regions, preferably of copper, at both cold and hot ends. The two screen regions are thermally connected to copper blocks to form the cold and hot end heat exchangers 18, 22. The screens are chosen to have good heat transfer to the gas. The aftercooler 14 and the hot end heat exchanger 2 are typically cooled in spacecraft applications by heat conduction or heat pipe transport to a local radiator surface or by use of a spacecraft forced flow coolant loop.

The compressor 12 generates an alternating pressure wave defined as $p=p_a+p_d\cos\omega t$, where $p_a$ is the average pressure in the pulse tube cooler 10 and $p_d$ is the dynamic pressure at the operating frequency $f=\omega/2\phi$. This pressure wave produces a mass flow defined as $m\cos(\omega t+\phi)$, where $\phi$ is the phase shift between the pressure wave and the mass flow at a particular position along the pulse tube cooler 10. The heat pumping action of the regenerator 16 is caused by the relative phase angle between the alternating pressure and mass flow. The phase angle $\phi$ varies along the pulse tube cooler 10 and must be within certain angle ranges at the cold end, so that heat from the cooling load is absorbed by the gas through the cold end heat exchanger 18, and within certain other angle ranges at the warm end, so that heat is removed from the gas by the hot end heat exchanger 22. The phase angle between the alternating pressure and mass flow of the gas can be fine tuned to maximize the cooling power of the cooler by choosing the proper size of the orifice 24 and the volume of the surge tank 26.

The heat pumping action can best be explained by considering an incremental volume of gas in the regenerator 16. During the compression stroke of the piston, the incremental volume of gas is compressed and thereby warmed to a temperature higher than the regenerator screens. The incremental volume of gas also begins to flow, with some time delay, toward the cold end of the regenerator. During this portion of the volume's travel, the gas transfers the heat generated by compression to the screens, thus lowering the temperature of the gas. Half a cycle later, during the expansion stroke of the piston, the incremental volume of gas, which is now at the lower temperature of the regenerator, is expanded and thereby cooled to a temperature lower than the screens. The incremental volume also begins to flow, with some time delay, toward the warm end of the regenerator. During this portion of the volume's travel, the gas absorbs heat from the regenerator screens. All incremental volumes of gas in the regenerator undergo this same cycle of pressure and mass flow, with the net result being a transfer of heat from the cold end of the regenerator to the warm end. The time delay or phase relationship between the pressure wave and the mass flow of the gas can be seen to be critical to the proper operation of the heat pumping action.

Figure 2:
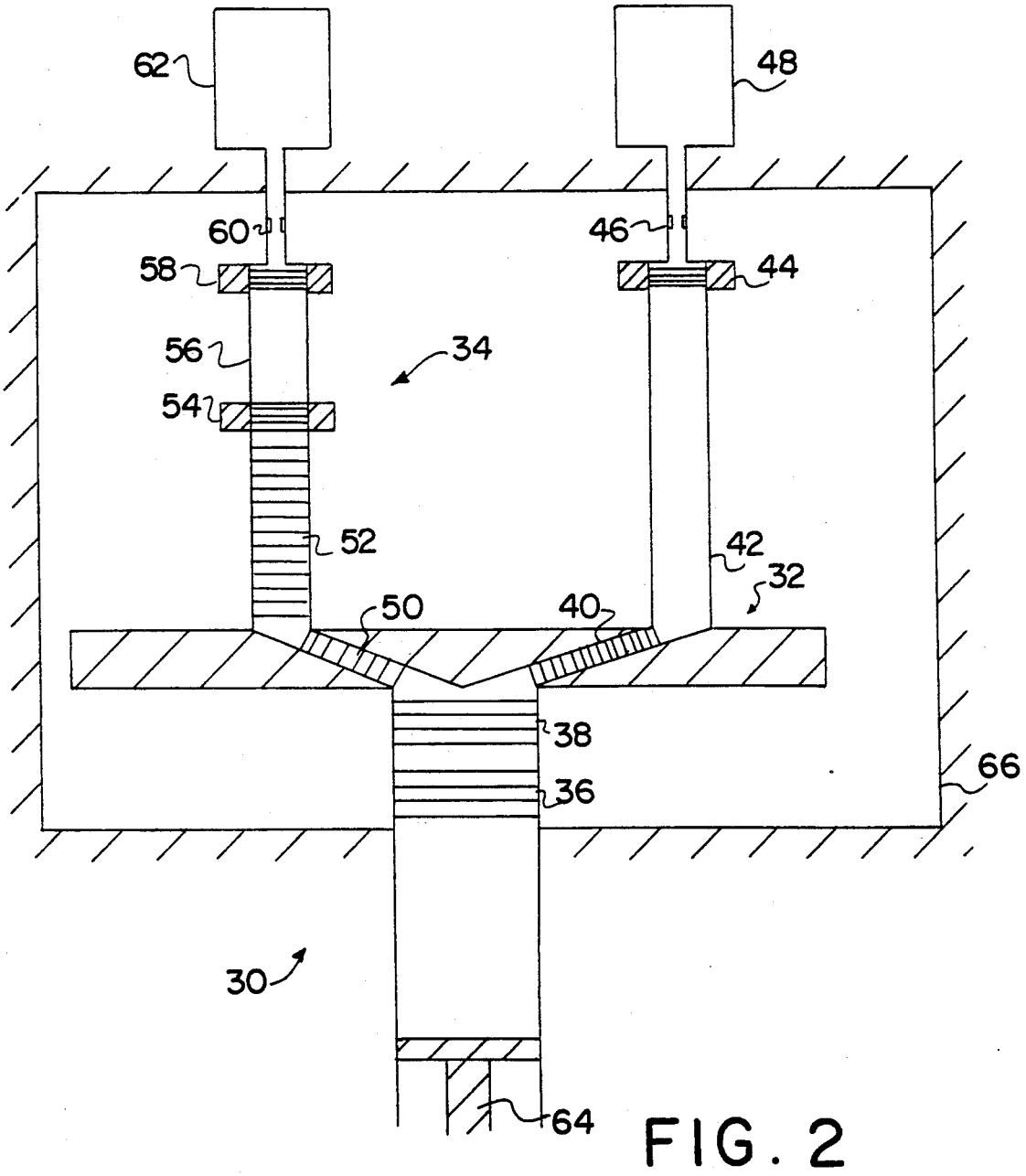
FIG. 2 is a sectional view of a two stage pulse tube cooler in accordance with the present invention.

As shown in FIG. 2, a two stage pulse tube cooler 30 in accordance with the present invention includes a higher-temperature or first stage pulse tube cooler 32 and a lower-temperature or second stage pulse tube cooler 34, with a portion of the heat from the second stage cooler 34 being rejected to a heat sink other than the first stage cooler 32, thus substantially improving the overall efficiency of the multistage cooler 30. The higher-temperature or first stage pulse tube cooler 32 includes, in series, an aftercooler 36, a regenerator 38, a cold end heat exchanger 40, a pulse tube 42, a hot end heat exchanger 44, an orifice 46 and a surge tank 48. The lower-temperature or second stage pulse tube cooler 34 extends from the cold end heat exchanger 40 of the first stage pulse tube cooler 32 and includes, in series, an aftercooler 50, a regenerator 52, a cold end heat exchanger 54, a pulse tube 56, a hot end heat exchanger 58, an orifice 60 and a surge tank 62.

In operation, a compressor 64 supplies a continuous pressure wave to the first stage aftercooler 36 and regenerator 38. After providing cooling in the first stage regenerator 38, the pressure wave enters both the first stage cold end heat exchanger 40 and the second stage aftercooler 50, the second stage aftercooler 50 being in thermal contact with the first stage cold end heat exchanger 40. The pressure wave provides further cooling in the second stage regenerator 52, with the second stage cold end heat exchanger 54 being in thermal contact with the cooling load (not shown). The pressure wave continues through the two pulse tubes 42, 56, where the PV work is rejected as heat to the heat sink by the hot end heat exchangers 44, 58.

All of the parts of the pulse tube cooler 30, except the compressor 64 and the surge tanks 48, 62, are preferably insulated to prevent extraneous heat leakage, which would be a parasitic heat load on the cooler 30. The insulating effect may be accomplished with standard insulating material or preferably by a high vacuum enclosure 66. The surge tanks 48, 62 are placed outside of the vacuum enclosure 66 to reduce cool down time and to reduce the volume of the vacuum enclosure.

Figure 3:
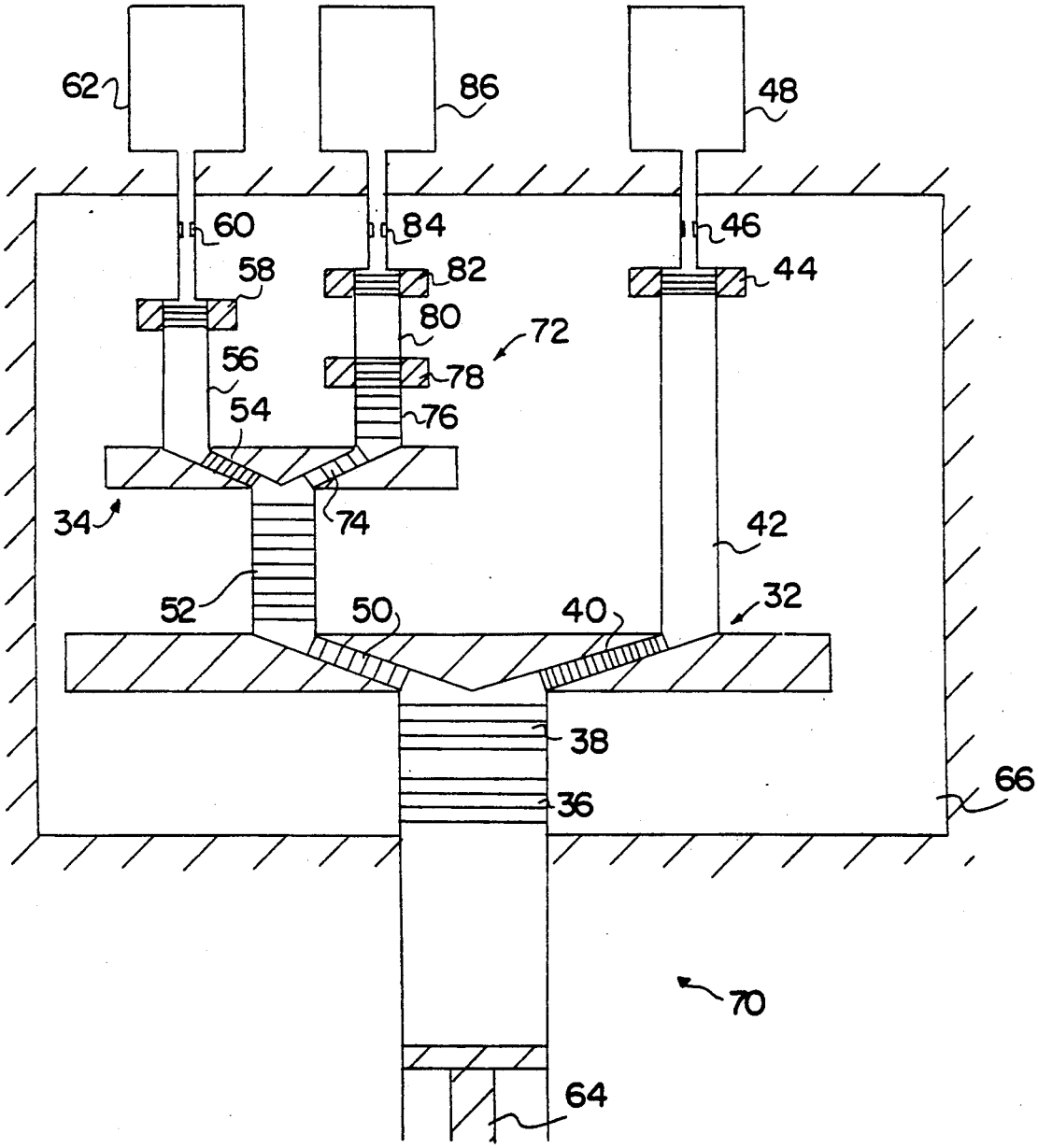
FIG. 3 is a sectional view of a three stage pulse tube cooler in accordance with the present invention.

As shown in FIG. 3, a three stage pulse tube cooler 70 in accordance with the present invention includes the first and second stage pulse tube coolers 32, 34 of the two stage pulse tube cooler 30 and a third stage pulse tube cooler 72, with a portion of the heat from the second and third stage coolers 34, 72 being rejected to a heat sink other than the first and second stage coolers 32, 34, respectively. The third stage pulse tube cooler 72 extends from the cold end heat exchanger 54 of the second stage pulse tube cooler 34 and includes, in series, an aftercooler 74, a regenerator 76, a cold end heat exchanger 78, a pulse tube 80, a hot end heat exchanger 82, an orifice 84 and a surge tank 86.

In operation, the compressor 64 supplies a continuous pressure wave to the first stage aftercooler 36 and regenerator 38. After providing cooling in the first stage regenerator 38, the pressure wave enters both the first stage cold end heat exchanger 40 and the second stage aftercooler 50, the second stage aftercooler 50 being in thermal contact with the first stage cold end heat exchanger 40. The pressure wave provides further cooling in the second stage regenerator 52 and then enters both the second stage cold end heat exchanger 54 and the third stage aftercooler 74, the third stage aftercooler 74 being in thermal contact with the second stage cold end heat exchanger 54. The pressure wave provides further cooling in the third stage regenerator 76, with the third stage cold end heat exchanger 78 being in thermal contact with the cooling load (not shown). The first and second stage cold end heat exchangers 40, 54 may also be in thermal contact with cooling loads which do not require as cold a temperature as provided by the third stage cold end heat exchanger 78. The pressure wave continues through the three pulse tubes 42, 56, 80, where the PV work is rejected as heat to the heat sink by the hot end heat exchangers 44, 58, 82.

From the foregoing, it will be appreciated that the present invention represents a significant advance in the field of multistage pulse tube coolers. Although several preferred embodiments of the invention have been shown and described, it will be apparent that other adaptations and modifications can be made without departing from the spirit and scope of the invention. Accordingly, the invention is not to be limited, except as by the following claims.

We claim:

1. A multistage pulse tube cooler for cooling a cooling load, comprising:

a first stage pulse tube cooler having an aftercooler, a cold end heat exchanger and a hot end heat exchanger, the first stage pulse tube cooler receiving a gas pressure wave that generates pressure/volume work to pump heat from the first stage cold end heat exchanger to the first stage aftercooler; and a second stage pulse tube cooler having an aftercooler, a cold end heat exchanger and a hot end heat exchanger, the second stage pulse tube cooler receiving a cooled gas pressure wave from the first stage pulse tube cooler that generates pressure/volume work to pump heat from the second stage cold end heat exchanger to the second stage aftercooler;

wherein the second stage aftercooler is in thermal contact with and cooled by the first stage cold end heat exchanger and the cooling load is in thermal contact with the second stage cold and heat exchanger;

and wherein heat that accumulates in the first and second stage hot end heat exchangers due to the pressure/volume work is rejected to an external heat sink.

2. The multistage pulse tube cooler as set forth in claim 1, and further including:

a third stage pulse tube cooler having an aftercooler, a cold end heat exchanger and a hot end heat exchanger, the third stage pulse tube cooler receiving a cooled gas pressure wave from the second stage pulse tube cooler that generates pressure/volume work to pump heat from the third stage cold end heat exchanger to the third stage aftercooler;

wherein the third stage aftercooler is in thermal contact with and cooled by the second stage cold end heat exchanger and the cooling load is in thermal contact with the third stage cold end heat exchanger;

and wherein heat that accumulates in the third stage hot end heat exchanger due to the pressure/volume work is rejected to the heat sink other than the second stage cold end heat exchanger.

3. The multistage pulse tube cooler as set forth in claim 1, and further including:

thermal insulation means for insulating the pulse tube coolers;

wherein the external heat sink is external of the insulation means.

4. The multistage pulse tube cooler as set forth in claim 2, and further including:

thermal insulation means for insulating the pulse tube coolers;

wherein the external heat sink is external of the insulation means.

5. A multistage pulse tube cooler for cooling a cooling load, comprising:

a first stage pulse tube cooler having, in series, an aftercooler, a regenerator, a cold end heat exchanger, a pulse tube and a hot end heat exchanger, the first stage pulse tube cooler receiving a gas pressure wave that generates pressure/volume work to pump heat from the first stage cold end heat exchanger to the first stage aftercooler; and a second stage pulse tube cooler having, in series, an aftercooler, a regenerator, a cold end heat exchanger, a pulse tube and a hot end heat exchanger, the second stage pulse tube cooler receiving a cooled gas pressure wave from the first stage pulse tube cooler that generates pressure/volume work to pump heat from the second stage cold end heat exchanger to the second stage aftercooler;

wherein the second stage pulse tube cooler extends from the first stage cold end heat exchanger and the second stage aftercooler is in thermal contact with and cooled by the first stage cold end heat exchanger and the cooling load is in thermal contact with the second stage cold end heat exchanger;

and wherein heat that accumulates in the first and second stage hot end heat exchangers due to the pressure/volume work is rejected to an external heat sink.

6. The multistage pulse tube cooler as set forth in claim 5, and further including:

a third stage pulse tube cooler having, in series, an aftercooler, a regenerator, a cold end heat exchanger, a pulse tube and a hot end heat exchanger, the third stage pulse tube cooler receiving a cooled gas pressure wave from the second stage pulse tube cooler that generates pressure/volume work to pump heat from the third stage cold end heat exchanger to the third stage aftercooler;

wherein the third stage pulse tube cooler extends from the second stage cold end heat exchanger and the third stage aftercooler is in thermal contact with and cooled by the second stage cold end heat exchanger and the cooling load is in thermal contact with the third stage cold end heat exchanger;

and wherein heat that accumulates in the third stage hot end heat exchanger due to the pressure/volume work is rejected to a heat sink other than the second stage cold end heat exchanger.

7. The multistage pulse tube cooler as set forth in claim 5, and further including:

thermal insulation means for insulating the pulse tube coolers;

wherein the external heat sink is external of the insulation means.

8. The multistage pulse tube cooler as set forth in claim 6, and further including:

thermal insulation means for insulation the pulse tube coolers;

wherein the external heat sink is external of the insulation means.

9. The multistage pulse tube cooler as set forth in claim 5, and further including a compressor for providing the pressure wave.

10. A method for staging multiple pulse tube coolers, the method comprising the steps of:

arranging a plurality of pulse tube coolers to provide successively lower temperatures, each pulse tube cooler having an aftercooler, a cold end heat exchanger and a hot end heat exchanger for receiving a gas pressure wave that generates pressure/-volume work to pump heat from the cold end heat exchanger to the aftercooler;

cooling each successively lower-temperature aftercooler by thermal contact with a higher-temperature cold end heat exchanger; and rejecting heat that accumulates in the hot end heat exchangers due to the pressure/volume work to an external heat sink.

11. The method for staging multiple pulse tube coolers as set forth in claim 10, wherein each successively lower-temperature pulse tube cooler receives a cooled gas pressure wave from a higher-temperature pulse tube cooler.

* * * * *